US005966845A

United States Patent [19]

DiGiacomo

[11] Patent Number: 5,966,845

[45] Date of Patent: Oct. 19, 1999

[54] AIR STREAM DEFLECTOR FOR A SNOW PLOW

[76] Inventor: William E. DiGiacomo, 59 Upper Rd., Ellington, Conn. 06029-4304

[21] Appl. No.: 09/057,727

[22] Filed: Apr. 9, 1998

[51] Int. Cl.[6] ..... B60J 1/00; E01H 5/00; E01H 5/04

[52] U.S. Cl. ..... 37/231; 37/241; 37/266; 296/180.1

[58] Field of Search ..... 37/231, 266, 270, 37/241; 296/180.1

[56] References Cited

U.S. PATENT DOCUMENTS

| | | | |
|---|---|---|---|
| 2,085,996 | 7/1937 | Phillips | 37/42 |
| 3,432,947 | 3/1969 | Peitl | 37/42 |
| 4,024,922 | 5/1977 | Ronald | 172/801 |
| 4,587,750 | 5/1986 | Larson | 37/241 |
| 4,896,915 | 1/1990 | Morandi et al. | 296/180.1 |
| 5,155,929 | 10/1992 | Vachon | 37/266 |
| 5,309,653 | 5/1994 | Pease et al. | 37/266 |
| 5,544,434 | 8/1996 | Calvachio, Jr. | 37/266 |

*Primary Examiner*—Thomas B. Will
*Assistant Examiner*—Gary S. Hartmann
*Attorney, Agent, or Firm*—Albert W. Hilburger

[57] ABSTRACT

An air deflection system for a snow plow assembly mounted on a vehicle comprises an air stream guide member mounted on and overlying the upper surface of a snow plow blade. The guide member has a downwardly facing air inlet at a fore end positioned forward of the snow plow blade to intercept and capture without interruption an air stream which, by reason of forward movement of the vehicle, is directed toward the leading concave surface of the snow plow blade, then upwardly along that surface, and through a rearwardly facing air outlet at the aft end positioned aft of the snowplow blade. An air stream containment passage intermediate the air inlet and the air outlet is effective to receive the air stream from the air inlet and redirect it toward the air outlet from whence it is exhausted away from the snow plow blade and toward the radiator of the motor vehicle. The air stream guide member includes a base member, an air engaging wall extending continuously between the air inlet and the air outlet, and opposed laterally spaced longitudinally extending side walls, all components being integral. Bracket members mount the air stream guide member on the snow plow blade and positioning devices releasably fix the orientation of the air stream guide member relative to the snow plow blade.

16 Claims, 2 Drawing Sheets

AIR STREAM DEFLECTOR FOR A SNOW PLOW

BACKGROUND OF THE INVENTION

1. Field of the Invention

The present invention relates generally to air flow deflectors for motor vehicles and, more particularly, to an air flow deflector mounted on a snow plow blade supported by a motor vehicle to direct an air flow stream towards the vehicle radiator.

2. Description of the Prior Art

Snow plow blades are commonly mounted on the front of motor vehicles, such as a truck or Jeep®, for conducting snow plowing operations and are very popular in geographical areas which receive a great deal of snow. Although the front mounting of the snow plow blade has many advantages when plowing snow, it has a major drawback when being carried in a non-plowing or transport position. In a transport position, the snow plow blade is typically aligned in front of the vehicle, blocking the air flow to the vehicle radiator. Since an air flow through the radiator is necessary to cool the water flowing through its coils, this blockage of the air flow frequently causes the vehicle to overheat, particularly on warmer days. Overheating of the motor vehicle can result in damage to the internal parts of the vehicle.

Numerous air flow detectors have previously been devised to reduce the drag of air flowing against frontal surfaces of a vehicle carrying a snow plow blade or to redirect the flow of air. However, these deflectors are often ineffective in providing sufficient air flow to the vehicle's engine, are complex in construction, difficult to use and expensive to manufacture and maintain.

U.S. Pat. No. 5,544,434 to Calvachio, Jr. discloses an air flow deflector for a snow plow mounted on a motor vehicle which includes a deflector fin for deflecting air flow against the radiator of the motor vehicle. The deflector fin includes a main body having an upper surface, a lower surface and opposite side surfaces. A mounting arrangement is provided for mounting the deflector fin in adjustable angular relation to a top surface of the snow plow and in spaced relation to the top surface of the snow plow so as to define an air flow passage therebetween. An arrangement is also provided for releasably fixing the orientation of the deflector fin with respect to the mounting arrangement.

U.S. Pat. No. 5,309,653 to Pease et al. discloses an arcuate foil located above a snowplow vehicle's moldboard at a preselected distance according to the size and shape of the plow. It is built into or attached to the snowplow for the purpose of capturing and controlling the snow particles coming over the top of the moldboard. A belt is attached to the top margin of the moldboard. The front edge of the foil is projected forward and above the top margin of the moldboard. The foil directs the snow particles and air from an upward direction to a downward direction as the snow particles and air are passing over and through the foil. The patented invention also prevents or reduces the amount of dust, snow and other debris that is normally present between the front end of the snowplow vehicle and the back side of the moldboard from being blown into the plow vehicle. In a conventional snowplow, reduced pressure is created at the back side of the moldboard as the plow vehicle moves along a road. This causes suction and the greater the speed the greater the suction. This suction normally causes debris immediately behind the moldboard to be lifted off the ground and blown into the vehicle. By providing a downward flow of air between the moldboard and the vehicle, the Pease et al. patent claims to prevent this from happening.

U.S. Pat. No. 4,896,915 to Morandi et al. discloses a wind deflector for a snow plow on a motor vehicle that has a plow pump bar and a radiator. The deflector includes a deflecting plate mounted on the pump bar such that when the plow is in position the deflecting plate will deflect air from above the plow down behind the plow and into the radiator of the motor vehicle to prevent overheating. In a modification, an elongated funnel shaped deflecting housing is mounted to the top of the plow in place of the deflecting plate.

U.S. Pat. No. 4,587,750 to Larson discloses an air scoop mountable on a snow plow blade to direct air towards the vehicle radiator when the snow plow blade is being carried in a transport position. The air scoop arrangement includes an air channeling member having an air engaging wail and a pair of side wails extending from opposite edges of the air stream engaging wall. The air channeling member is mounted on an upper end of the snow plow blade with most of the air engaging wail projecting above the upper end of the snow plow blade. When the vehicle is being driven down the road, the channeling member is said to engage a portion of the air blowing over the snow plow blade and direct it towards the vehicle radiator.

U.S. Pat. No. 3,432,947 to Peitl discloses a snow deflector for directing the snow blown over a snowplow blade into the ground, away from the vehicle operator's line of vision. More specifically, an elongated member extends in generally parallel spaced relationship above the top edge of the blade and has a cross sectional configuration such as to cause a flow of air downwardly from the lop of the blade and between the back side of the blade and the front end of the propelling vehicle. The cross-sectional shape may be as desired but in the preferred embodiment is generally slightly curved from the leading edge to the trailing edge, with the leading edge sloping downwardly and rearwardly at a 20° angle to the trailing edge at a 60° angle.

U.S. Pat. No. 2,085,996 to Phillips discloses a deflector used on snow plows which prevents the wind from blowing the snow on the radiator or onto the windshield. It is designed to direct down towards the ground the wind that strikes against the moldboard of the snow plow. The patent recognizes that prior to the disclosed invention, drivers of snow plow vehicles can experience great difficulty in steering because of the snow that is blown up over the moldboard onto the windshield, often completely covering the windshield in a very few minutes and thereby obstructing the vision of the driver; that also, the snow is often blown onto the radiator of the automobile thereby interfering with the circulation of the water in the radiator and causing the water in the radiator to boil.

It was with knowledge of the foregoing state of the technology that the present invention has been conceived and is now reduced to practice. None of these known constructions employs a downwardly facing air intake which intercepts the upward flow of air which develops on the front surface of the snow plow blade, then redirects the flow of air rearwardly toward the radiator of the motor vehicle for cooling the water flowing through the coils of the radiator.

SUMMARY OF THE INVENTION

The present invention relates to an air deflection system for a snow plow assembly mounted on a vehicle and comprises an air stream guide member mounted on and overlying the upper surface of a snow plow blade. The air stream guide member has a downwardly facing air inlet at a fore end positioned forward of the snow plow blade to intercept and capture without interruption an air stream which, by reason of forward movement of the vehicle, is directed toward the leading concave surface of the snow plow blade, then upwardly along that surface, and through a rearwardly facing air outlet at the aft end positioned aft of the snowplow blade. An air stream containment passage intermediate the air inlet and the air outlet is effective to receive the air stream from the air inlet and redirect it toward the air outlet from whence it is exhausted away from the snow plow blade and toward the radiator of the motor vehicle. The air stream guide member includes a base member, an air stream engaging wall extending continuously between the air inlet and the air outlet, and opposed laterally spaced longitudinally extending side walls, all components being integral. Bracket members mount the air stream guide member on the snow plow blade and positioning devices releasably fix the orientation of the air stream guide member relative to the snow plow blade.

A primary feature, then, of the present invention is the provision of an air stream guide member for a snow plow on a motor vehicle that will overcome the shortcomings of the prior art devices.

Another feature of the present invention is to provide an air stream guide member for a snow plow on a motor vehicle that is mounted directly on a top surface of the snow plow blade to deflect sufficient air flow to the radiator of the motor vehicle.

Still another feature of the present invention is to provide an air stream guide member for a snow plow mounted on a motor vehicle which is simple in construction, easy to use and economical to manufacture and maintain.

Yet another feature of the present invention is to provide an air stream guide member for a snow plow mounted on a motor vehicle provided with a construction for releasably fixing its orientation relative to the snow plow blade.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

DETAILED DESCRIPTION OF THE PREFERRED EMBODIMENTS

Figure 1:
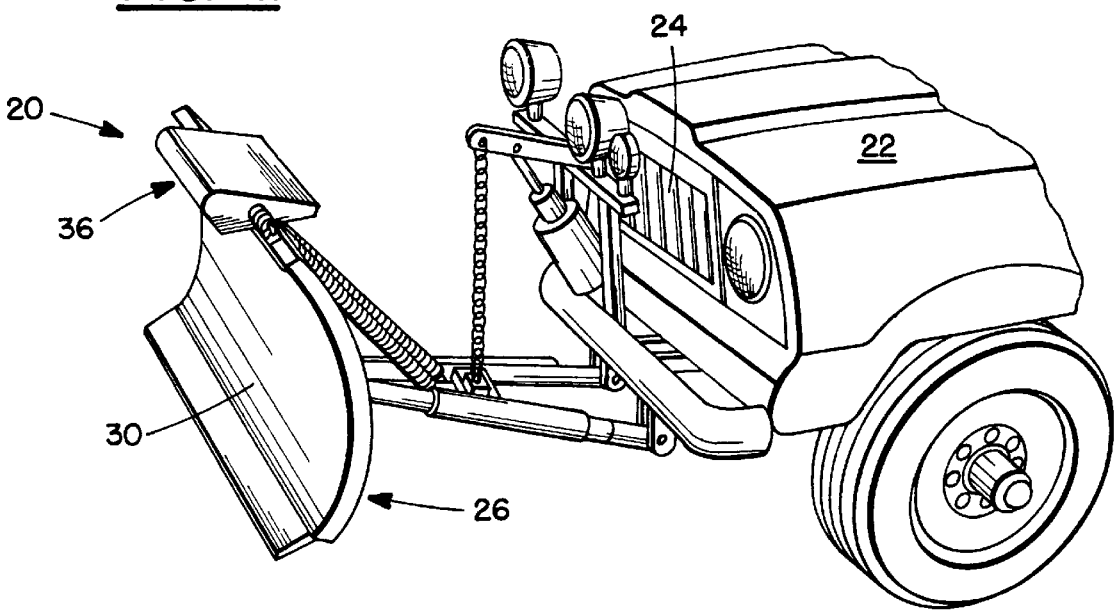
FIG. 1 is a perspective view of a snow plow assembly embodying the present invention as carried by a plowing vehicle.
Figure 2:
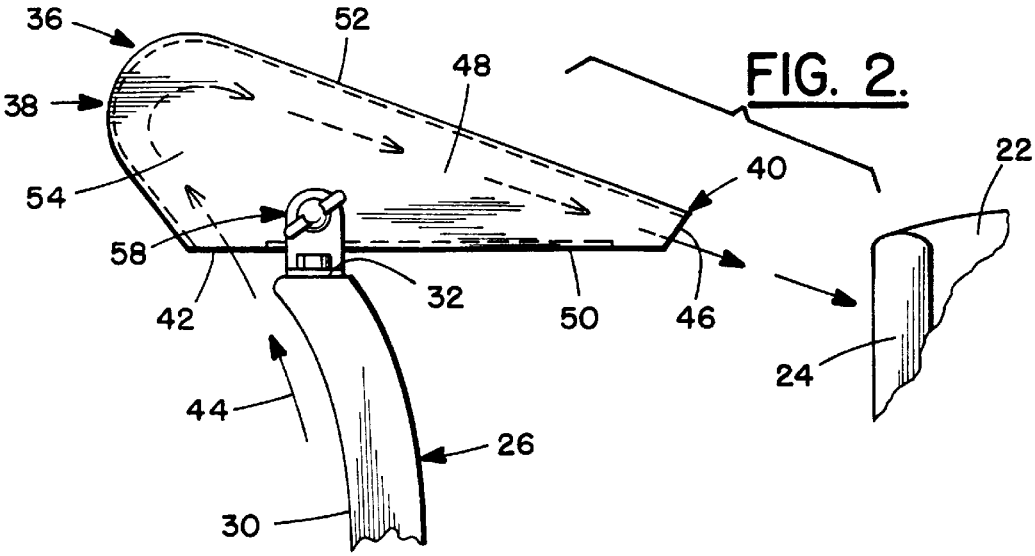
FIG. 2 is a detail side elevation view primarily illustrating the air stream guide member of the invention.
Figure 3:
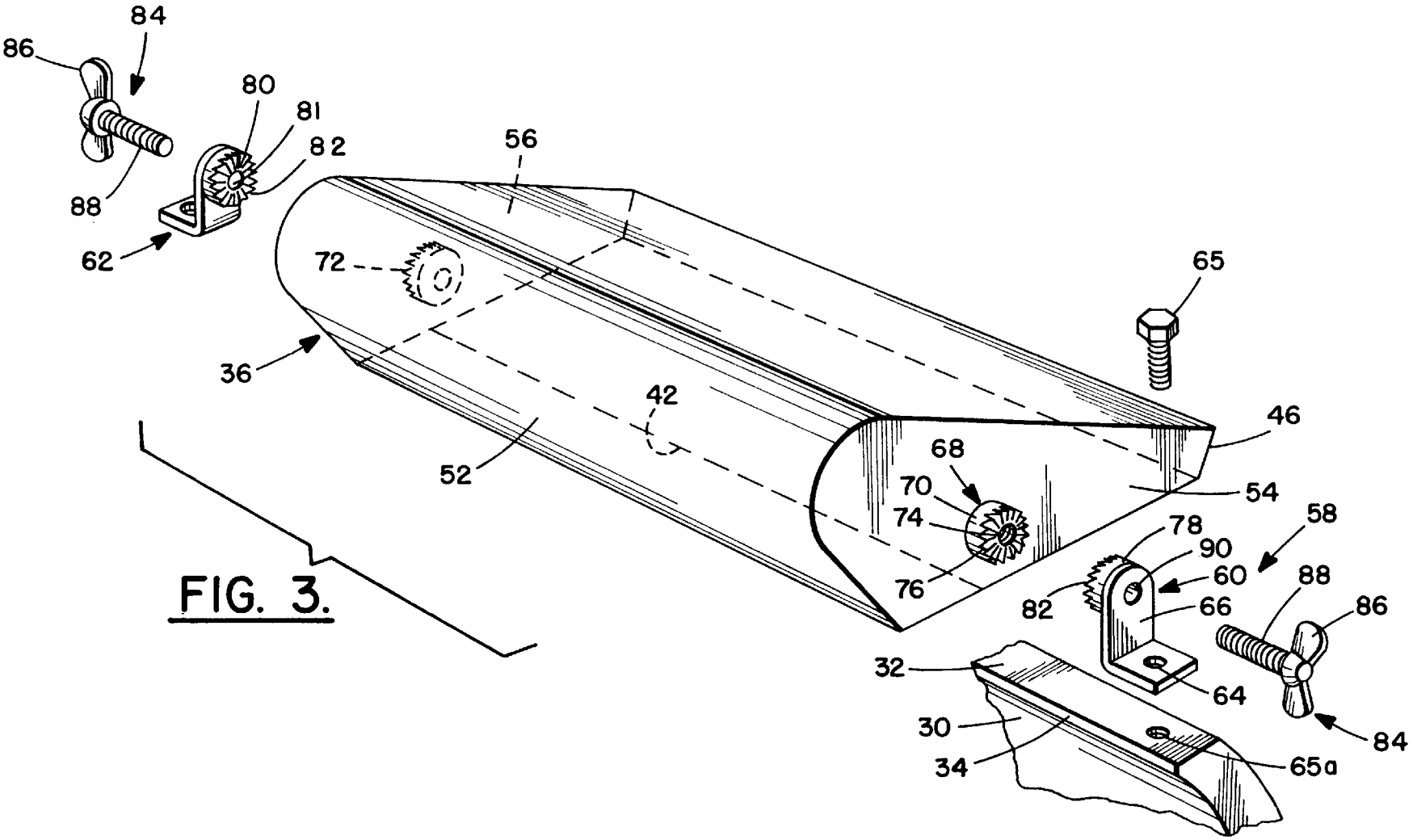
FIG. 3 is an exploded perspective view illustrating a mounting arrangement for the air stream guide member of the invention.

Turn now to the drawings and, initially, to FIG. 1 which generally illustrates a snow plow assembly 20 mounted on a vehicle 22 having a radiator 24. In typical fashion, the snow plow assembly 20 includes a snow plow blade 26 mounted on a front end of the vehicle. The snow plow blade 26 has a leading surface 30 which is concave about a generally laterally extending axis and terminating at an upper surface 32 of a flange 34 (FIGS. 2 and 3).

Figure 4:
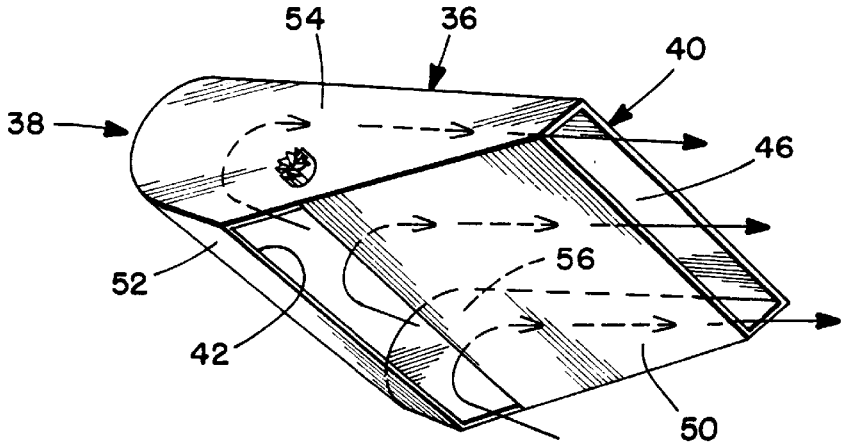
FIG. 4 is a detail perspective view illustrating the air stream guide member of the invention in a different orientation.

In accordance with the invention, more particularly viewing FIGS. 2, 3, and 4, an air stream guide member 36 is illustrated mounted on the snow plow blade 26 in a manner to be described below. The air stream guide member 36 extends between a fore end 38 and an aft end 40 and overlies the upper surface 32 of the snow plow blade 26. The air stream guide member includes a downwardly facing air inlet 42 at the fore end 38 positioned forward of the snow plow blade 26 to intercept and capture without interruption an air stream defined by a continuing series of arrows 44. More specifically, by reason of forward movement of the vehicle 22, the air stream 44 is directed toward the leading concave surface 30 of the snow plow blade 26, then upwardly generally along the surface 30 and into the downwardly facing air inlet 42. The air stream guide member 36 also includes a rearwardly facing air outlet 46 at the aft end 40 positioned aft of the snowplow blade 26 and an air stream containment passage 48 intermediate the air inlet 42 and the air outlet 46. The passage 48 is effective to receive the air stream from the air inlet 42 and redirect it toward the air outlet 46 from whence it is exhausted away from the snow plow blade 26 and toward the radiator 24 of the motor vehicle 22.

The air stream guide member 36 includes a base member 50, an air stream engaging wall 52 extending continuously between the air inlet 42 and the air outlet 46, and opposed laterally spaced longitudinally extending side walls 54, 56. The base member 50, the air stream engaging wall 52 and the side walls 54, 56, are all integral. If the air stream guide member 36 is made of metal, for example, the components may be joined by welding; if made of a plastic material, it may be molded as a unit.

A bracket construction 58 may be employed for mounting the air stream guide member 36 on the upper surface 32 of the snow plow blade 26. Viewing especially FIG. 3, the bracket construction 58 includes a pair of laterally spaced upright support arms 60, 62, each having a flanged first end 64 secured to the flange 34 of the snow plow blade by means of bolts 65 which can threadedly engage tapped bores 65*a* in the flange 34. Second ends 66 of the support arms 60, 62 are attached to the air stream guide member at spaced locations, respectively, to enable rotation of the air stream guide member about a lateral axis in a manner to be described. Toward this end, a positioning mechanism 68 is provided for releasably fixing the orientation of the air stream guide member relative to said snow plow blade and about the afore-mentioned lateral axis.

The positioning mechanism 68 includes a pair of laterally aligned and spaced first hub members 70, 72 fixed, respectively, on the opposed side walls 54, 56 of the air stream guide member. Each of the first hub members has an internally tapped bore 74 and is formed with a circular row of laterally outwardly facing first ratchet teeth 76. Second hub members 78, 80 are integral, respectively, with an upper extremity of each second end 66 of the upright support arms 60, 62, and each of the second hub members has a clearance bore 81 extending therethrough. Also, each of the second hub members is formed with a circular row of laterally inwardly facing second ratchet teeth 82. The second ratchet teeth 82 of each of the second hub members 78, 80 is engageable, respectively, with the first ratchet teeth 76 of an associated one of the first hub members 70, 72. A male fastener 84, possibly with butterfly ears 86 for ease of manipulation, has a threaded shank 88 which is freely receiveable through the clearance bore 81 of each of the second hub members 78, 80 and through an aligned clearance bore 90 of each associated second end 66 is threadedly engageable with the tapped bore 74 of an associated one of the first hub members 70, 72. The male fasteners 84 are capable of being tightened to draw the first and second pairs of ratchet teeth 76, 82 together to fixedly maintain said air stream guide member at a selected orientation relative to the snow plow blade 26. With this construction, the orientation of the air stream guide member 36 can be selected, then maintained, until it is desired to change it at a later time.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. An air deflection system for a snow plow assembly mounted on a vehicle having a radiator and operable for directing cooling air toward the radiator, said air deflection system comprising:

a hollow air stream guide member extending between a fore end and an aft end and overlying and mounted on an upper surface of a snow plow blade of the snow plow assembly, said air stream guide member including a base member, an air engaging wall, and opposed spaced apart longitudinally extending side walls respectively joining said base member and said air engaging wall, said air stream guide member having a downwardly facing air inlet at said fore end intermediate said base member and said air engaging wall and positioned forward of the snow plow blade to intercept and capture without interruption an air stream which, by reason of forward movement of the vehicle, is directed toward a leading concave surface of the snow plow blade, then upwardly along the leading concave surface, said air stream guide member having a rearwardly facing air outlet at said aft end positioned aft of the snowplow blade intermediate said base member and said air engaging wall and an air stream containment passage intermediate the air inlet and the air outlet, said passage effective to receive the air stream from the air inlet and redirect it toward the air outlet from whence it is exhausted away from the snow plow blade and toward the radiator of the motor vehicle.

2. An air deflection system as set forth in claim 1 including:

means for mounting said air stream guide member on the upper surface of the snow plow blade.

3. An air deflection system as set forth in claim 1 including:

means for adjustably mounting said air stream guide member on the upper surface of the snow plow blade.

4. An air deflection system as set forth in claim 3 wherein said mounting means includes:

means for releasably fixing the orientation of said air stream guide member relative to the snow plow blade.

5. An air deflection system as set forth in claim 3 wherein said mounting means includes:

bracket means for mounting said air stream guide member on the upper surface of the snow plow blade in adjustable angular relation thereto.

6. An air deflection system as set forth in claim 5 wherein said bracket means includes a pair of laterally spaced upright support arms, each having a first end secured to the snow plow blade and a second end attached to said air stream guide member at spaced locations for rotation of said air stream guide member about a lateral axis.

7. An air deflection system as set forth in claim 1 wherein said air stream guide member includes a base member, an air engaging wall extending continuously between the air inlet and the air outlet, and opposed laterally spaced longitudinally extending side walls, said base member, said air engaging wall, and said side walls all being integral; and including:

bracket means for mounting said air stream guide member on the upper surface of the snow plow blade, said bracket means including a pair of laterally spaced upright support arms, each having a first end secured to the snow plow blade and a second end attached to said air stream guide member at spaced locations for rotation of said air stream guide member about a lateral axis; and positioning means for releasably fixing the orientation of said air stream guide member relative to the snow plow blade.

8. An air deflection system as set forth in claim 7 wherein said positioning means includes:

a pair of laterally aligned and spaced first hub members fixed, respectively, on said opposed side walls of said air stream guide member, each of said first hub members having an internally tapped bore, each of said first hub members formed with a circular row of laterally outwardly facing first ratchet teeth;

a second hub member integral with an upper extremity of each of said upright support arms, each of said second hub members having a clearance bore therethrough, each of said second hub members formed with a circular row of laterally inwardly facing second ratchet teeth, said second ratchet teeth of each of said second hub members being engageable with said first ratchet teeth of an associated one of said first hub members;

a male fastener having a threaded shank freely receiveable through the clearance bore of each of said second hub members and threadedly engageable with the tapped bore of an associated one of said first hub members;

said male fasteners capable of being tightened to draw said first and second pairs of ratchet teeth together to fixedly maintain said air stream guide member at a selected orientation relative to the snow plow blade.

9. A snow plow assembly mounted on a vehicle having a radiator and operable for directing cooling air toward the radiator, said snow plow assembly comprising:

a snow plow blade mounted on the front end of the vehicle, said snow plow blade having a leading surface concave about a generally laterally extending axis and terminating at an upper surface;

a hollow air stream guide member extending between a fore end and an aft end and overlying and mounted on said upper surface of said snow plow blade, said air stream guide member including a base member, an air engaging wall, and opposed spaced apart longitudinally extending side walls respectively joining said base member and said air engaging wall said air stream guide member having a downwardly facing air inlet at said fore end intermediate said base member and said air engaging wall and positioned forward of said snow plow blade to intercept and capture without interruption an air stream which, by reason of forward movement of the vehicle, is directed toward said leading concave surface of said snow plow blade, then upwardly along said leading concave surface, said air stream guide member having a rearwardly facing air outlet at said aft end positioned aft of said snowplow blade intermediate said base member and said air engaging wall and an air stream containment passage intermediate the air inlet and the air outlet, said passage effective to receive the air stream from the air inlet and redirect it toward the air outlet from whence it is exhausted away from said snow plow blade and toward the radiator of the motor vehicle.

10. An air deflection system as set forth in claim 9 including:

means for mounting said air stream guide member on said upper surface of said snow plow blade.

11. An air deflection system as set forth in claim 9 including:

means for adjustably mounting said air stream guide member on said upper surface of said snow plow blade.

12. An air deflection system as set forth in claim 11 wherein said mounting means includes:

means for releasably fixing the orientation of said air stream guide member relative to said snow plow blade.

13. An air deflection system as set forth in claim 12 wherein said mounting means includes:

bracket means for mounting said air stream guide member on said upper surface of said snow plow blade in adjustable angular relation thereto.

14. An air deflection system as set forth in claim 13 wherein said bracket means includes a pair of laterally spaced upright support arms, each having a first end secured to the snow plow blade and a second end attached to said air stream guide member at spaced locations for rotation of said air stream guide member about a lateral axis.

15. An air deflection system as set forth in claim 9 wherein said air stream guide member includes a base member, an air engaging wall extending continuously between the air inlet and the air outlet, and opposed laterally spaced longitudinally extending side walls, said base member, said air engaging wall, and said side walls all being integral; and including:

bracket means for mounting said air stream guide member on the upper surface of said snow plow blade, said bracket means including a pair of laterally spaced upright support arms, each having a first end secured to said snow plow blade and a second end attached to said air stream guide member at spaced locations for rotation of said air stream guide member about a lateral axis; and positioning means for releasably fixing the orientation of said air stream guide member relative to said snow plow blade.

16. An air deflection system as set forth in claim 15 wherein said positioning means includes:

a pair of laterally aligned and spaced first hub members fixed, respectively, on said opposed side walls of said air stream guide member, each of said first hub members having an internally tapped bore, each of said first hub members formed with a circular row of laterally outwardly facing first ratchet teeth;

a second hub member integral with an upper extremity of each of said upright support arms, each of said second hub members having a clearance bore therethrough, each of said second hub members formed with a circular row of laterally inwardly facing second ratchet teeth, said second ratchet teeth of each of said second hub members being engageable with said first ratchet teeth of an associated one of said first hub members;

a male fastener having a threaded shank freely receiveable through the clearance bore of each of said second hub members and threadedly engageable with the tapped bore of an associated one of said first hub members;

said male fasteners capable of being tightened to draw said first and second pairs of ratchet teeth together to fixedly maintain said air stream guide member at a selected orientation relative to said snow plow blade.

* * * * *